US006805302B2

(12) United States Patent
Boecking

(10) Patent No.: US 6,805,302 B2
(45) Date of Patent: Oct. 19, 2004

(54) INJECTOR FOR CONTROLLING FLUIDS

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 301 days.

(21) Appl. No.: 10/098,326

(22) Filed: Mar. 14, 2002

(65) Prior Publication Data

US 2002/0162900 A1 Nov. 7, 2002

(30) Foreign Application Priority Data

Mar. 14, 2001 (DE) ..... 101 12 147

(51) Int. Cl.[7] ..... B05B 1/08

(52) U.S. Cl. ..... 239/102.2; 239/88; 239/96; 239/533.4; 251/57; 251/129.06

(58) Field of Search ..... 239/88, 96, 102.2, 239/533.3, 533.4, 533.8, 533.9; 251/57, 129.06

(56) References Cited

U.S. PATENT DOCUMENTS 6,302,333 B1 * 10/2001 Hoffmann et al. ..... 239/102.2
6,581,900 B1 * 6/2003 Stoecklein ..... 251/57
6,698,711 B2 * 3/2004 Mattes ..... 251/57
6,705,544 B1 * 3/2004 Rueger et al. ..... 239/102.2

* cited by examiner

*Primary Examiner*—Steven J. Ganey
(74) *Attorney, Agent, or Firm*—Kenyon & Kenyon

(57) ABSTRACT

An injector for controlling fluids has a piezoelectric actuator and a hydraulic pressure intensifier. The hydraulic pressure intensifier is composed of a first piston, a second piston and a pressure chamber filled with fluid and situated between the two pistons. In addition, a control valve and a priming device are provided to replace the fluid loss in the pressure chamber caused by leakage. The priming device has a priming chamber filled with fluid, and leakage losses in the pressure chamber are replaced by fluid from the priming chamber during a return movement of the hydraulic pressure intensifier as a result of a displacement effect in the priming chamber created directly or indirectly by the first piston.

10 Claims, 1 Drawing Sheet

INJECTOR FOR CONTROLLING FLUIDS

FIELD OF THE INVENTION

The present invention relates to an injector for controlling fluids having a hydraulic pressure intensifier and a priming device to replace the fluid loss caused by leakage at the hydraulic pressure intensifier. In particular the present invention relates to an injector having a piezoelectric actuator for a pressure-controlled common-rail system.

BACKGROUND INFORMATION

In fuel injection systems with piezoelectric actuators, a control valve controlling the movement of the injector needle is often controlled through a hydraulic pressure intensifier rather than directly. The function of this hydraulic pressure intensifier is on the one hand to intensify the stroke of the piezoelectric actuator and on the other to isolate the control valve from any static thermal expansion of the actuator during operation. In order for the hydraulic pressure intensifier to operate accurately, it must always be completely full, since otherwise the stroke of the piezoelectric actuator would not be intensified, or would be intensified only incompletely. Since at every actuation of the hydraulic pressure intensifier a portion of the fluid (generally fuel) present in the hydraulic pressure intensifier is lost by leakage through clearances, it must be refilled between each injection. This re-filling can, for example, be implemented by using an appropriate arrangement of throttles by which the rail pressure of the system is throttled and tapped off in order to prime the hydraulic pressure intensifier. In that operation, the priming pressure may be dependent on the rail pressure or may be kept constant by a suitable non-return valve.

The type of priming described above, however, gives rise to several problems. On one hand, the arrangement as described results in permanent leakage, which adds to the leakage caused by the actuation of the hydraulic pressure intensifier to increase the total leakage. The result is a drop in efficiency of the injection. Furthermore, such an arrangement is comparatively expensive, since it requires a filter in order to prevent the ingress of dirt which would cause blocking of the hydraulic pressure intensifier. In addition, the throttles for throttling the rail pressure have to be made extremely accurately, in order to permit precise priming of the hydraulic pressure intensifier. As a result, the known priming device becomes very expensive.

SUMMARY OF THE INVENTION

The injector according to the present invention for controlling fluids has the advantage over the related art that the priming of a pressure chamber of the hydraulic pressure intensifier takes place simultaneously with the return of the hydraulic pressure intensifier to its starting position. In that operation, a first piston of the hydraulic pressure intensifier creates a displacement effect in a priming chamber of a priming device, either directly or indirectly. As a consequence of the return of the first piston, fluid is displaced from the priming chamber and directed to the pressure chamber of the hydraulic pressure intensifier, in order to compensate for the leakage losses which have occurred there. By this approach, according to the present invention a particularly simple and compact priming device can be created, having only a small number of components, in particular since the first piston of the hydraulic pressure intensifier can be used as the actuating member of the priming device. In addition, in a device according to the present invention no additional leakage losses occur. According to the present invention a priming pump integrated in the injector is provided for the hydraulic pressure intensifier, this pump having a minimum number of components and refilling the pressure chamber every time that the hydraulic pressure intensifier is returned. In this way, the pressure chamber is constantly filled, in preparation for every injection.

In order to create a particularly compact priming device, the priming chamber of the priming device is advantageously situated directly at the end of the first piston facing the piezoelectric actuator. Thereby the first piston is able to displace fluid directly from the priming chamber as it returns to its starting position and thus compensate for the leakage losses in the pressure chamber.

In order to make the priming chamber simple to produce, it is advantageous if it is formed in an annular shape.

According to another preferred embodiment of the present invention the priming chamber is surrounded by a primer housing. In a particularly advantageous embodiment the priming chamber is formed as a recess in the primer housing.

According to a further preferred embodiment of the present invention the first piston is situated in a cylinder-ring-shaped sleeve.

It is advantageous if the return of the hydraulic pressure intensifier is brought about by a spring component situated between the piezoelectric actuator and the hydraulic pressure intensifier.

In a particularly advantageous embodiment, the spring component is supported by the primer housing. As a result, the spring component simultaneously also provides a seal between the primer housing and the cylindrical sleeve of the first piston.

It is advantageous if an intermediate piston is situated between the piezoelectric actuator and the first piston, on which a disk-shaped element is situated. The disk-shaped element is designed in the form of a seat for the spring component. As a result, the hydraulic pressure intensifier is returned via the disk-shaped element and the intermediate piston, which is rigidly connected to the first piston.

In a particularly advantageous embodiment, the disk-shaped element is formed as a snap ring, which is situated in a slot formed in the intermediate piston. This makes it possible for the construction to be particularly simple.

It is advantageous if a fluid leak duct is provided in the area of the first piston in order to remove the leaked fluid from the hydraulic pressure intensifier.

The injector according to the present invention can be used particularly advantageously with accumulator-type fuel injection systems such as the common-rail system.

DETAILED DESCRIPTION

Figure 1:
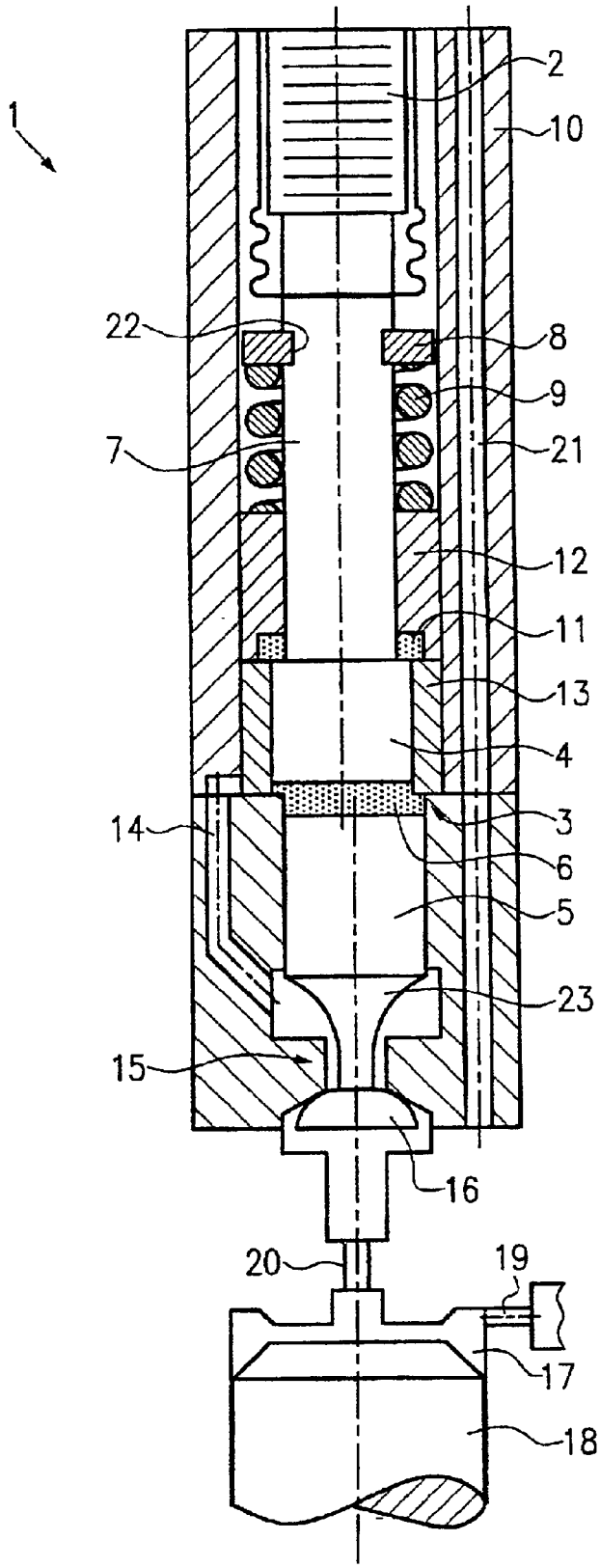
FIG. 1 shows a cross-sectional representation of a fuel injector with a priming device according to an exemplary embodiment of the present invention.

FIG. 1 shows a cross-sectional representation of an injector for controlling fluids according to an exemplary embodiment of the present invention. Injector 1 comprises a housing 10, in which a piezoelectric actuator 2, a hydraulic pressure intensifier 3 and a control valve 15 are situated.

Hydraulic pressure intensifier 3 includes a first piston 4, a second piston 5 and a pressure chamber 6 situated between the two pistons 4, 5. First piston 4 is connected to piezoelectric actuator 2 via an intermediate piston 7. Second piston 5 is connected to a valve element 16 of control valve 15 via an actuating member 23. First piston 4 is situated in a cylindrical sleeve 13 and is rigidly connected to intermediate piston 7.

The priming (filling) device according to the present invention has a priming (filling) chamber 11 and a primer housing 12. Primer housing 12 is formed in a sleeve shape and is situated around intermediate piston 7. Priming chamber 11 is situated at the end of primer housing 12 which faces first piston 4 (cf. FIG. 1). In order for piezoelectric actuator 2 or hydraulic pressure intensifier 3 to be returned, a spring component 9 is provided, which is supported at one end by primer housing 12 and at the other end by a disk-shaped element 8. Disk-shaped element 8, e.g. a snap ring, is situated in a slot 22 of intermediate piston 7 and acts as the seat for spring component 9. In addition a leak fluid duct 14 is situated in the vicinity of sleeve 13 of first piston 4, in order to collect the fluid leaking from the hydraulic pressure intensifier 3 in this area and remove it. Leak fluid pipe 14 is also connected to control valve 15.

As is further shown in FIG. 1, an injector needle 18 is situated in a control chamber 17, in order to allow the injection of fuel into a combustion chamber in a known manner. A throttle 20 is situated between control chamber 17 and the control valve. In addition a further throttle 19 (Z throttle) is situated in a connection between control chamber 17 and a high-pressure delivery duct 21 in order to reduce the pressure in control chamber 17.

The mode of operation of the injector according to the present invention will now be described.

If fuel is to be injected using injector 1, piezoelectric actuator 2 is activated, with the result that a change in length of piezoelectric actuator 2 occurs. This change in length is transmitted via intermediate piston 7 to first piston 4 of hydraulic pressure intensifier 3. On the basis of the ratio of the diameters of first piston 4 and second piston 5 of hydraulic pressure intensifier 3 the stroke of piezoelectric actuator 2 is intensified by hydraulic pressure intensifier 3. Via actuating member 23 the stroke of second piston 5 is transmitted to control valve 15, with the result that valve element 16 of control valve 15 lifts from its seat. As a result, control valve 15 opens a connection between control chamber 17 and leak fluid duct 14, with the result that the pressure in control chamber 17 drops. Consequently injector needle 18 moves toward control valve 15 causing injector needle 18 to lift from its seat (not shown), allowing injection of fuel in the known manner.

In order to end the injection of fuel, piezoelectric actuator 2 is deactivated and the components of injector 1 are returned by spring component 9. In this process piezoelectric actuator 2 is preloaded by the return force of spring component 9, acting via disk-shaped element 8 and intermediate piston 7. Furthermore, hydraulic pressure intensifier 3 is pulled back to its starting position by intermediate piston 7. As a consequence, valve element 16 of control valve 15 closes and outlet pressure builds up once again in control chamber 17, with the result that injector needle 18 is once again pressed onto its seat and the injection of fuel is concluded.

As shown in FIG. 1, during the return of hydraulic pressure intensifier 3, first piston 4 is also brought back to its starting position. Since an annular surface at the end of first piston 4 which faces piezoelectric actuator 2 is directly in contact with priming chamber 11, upon return of first piston 4 priming chamber 11 is pressurized, with the result that pressure chamber 6 of the hydraulic pressure intensifier is re-filled through the clearance between piston 4 and sleeve 13. Thus at the same time as the return of hydraulic pressure intensifier 3 the leakage losses which have occurred in pressure chamber 6 are also compensated for by the return movement of piston 4. During the return of the injector, the pressure in priming chamber 11 is less than the return force provided by spring component 9. The priming chamber may be refilled in the relatively long period between injections. Priming (filling) of priming chamber 11 may, however, also take place, for example, during injection if a non-return valve is situated between a reservoir for priming the priming chamber and priming chamber 11, and if this non-return valve operates as a result of the negative pressure in priming chamber 11 resulting from the movement of first piston 4.

The present invention may advantageously be used, in particular, with common-rail diesel injectors. However, the present invention may also, of course, be used with other injectors having a hydraulic pressure intensifier.

In addition, priming chamber 11 may be activated not only directly by first piston 4 but also indirectly, for example by the provision of several intermediate pistons or similar items.

Thus the present invention relates to an injector 1 for controlling fluids having a piezoelectric actuator 2 and a hydraulic pressure intensifier 3. Hydraulic pressure intensifier 3 consists of a first piston 4, a second piston 5 and a pressure chamber 6 situated between the two pistons and filled with fluid. In addition, a control valve 15 and a priming device 11, 12 are provided to replace the fluid losses from pressure chamber 6 caused by leakage. The priming device has a priming chamber 11 filled with fluid and leakage losses in pressure chamber 6 are replaced during a return movement of hydraulic pressure intensifier 3 by fluid from priming chamber 11, as a result of a displacement effect created directly or indirectly by first piston 4 in priming chamber 11.

The preceding description of the exemplary embodiment according to the present invention is given only for illustrative purposes and not for the purpose of delimiting the invention. Various alterations and modifications within the present invention are possible, without breaching the scope of the present invention or its equivalents.

What is claimed is:

1. An injector for controlling fluids comprising:

a piezoelectric actuator;

a hydraulic pressure intensifier including a first piston, a second piston and a pressure chamber, the pressure chamber being filled with fluid and being situated between the first and second pistons;

a control valve; and a priming device for replacing a fluid loss in the pressure chamber caused by leakage, the priming device having a priming chamber filled with fluid, with leakage losses in the pressure chamber being replaced by fluid from the priming chamber during a return movement of the hydraulic pressure intensifier as a result of a displacement effect in the priming chamber created, directly or indirectly, by the first piston.

2. The injector according to claim 1, wherein the priming chamber is situated directly at an end of the first piston facing the piezoelectric actuator.

3. The injector according to claim 1, wherein the priming chamber has an annular shape.

4. The injector according to claim 1, wherein the priming device includes a primer housing, the priming chamber being situated in the primer housing.

5. The injector according to claim 1, further comprising a cylindrical sleeve, the first piston being situated in the cylindrical sleeve.

6. The injector according to claim 1, further comprising a spring component for bringing about a return of the hydraulic pressure intensifier, the spring component being situated between the piezoelectric actuator and the hydraulic pressure intensifier.

7. The injector according to claim 6, wherein the priming device includes a primer housing for supporting the spring component.

8. The injector according to claim 6, further comprising:

an intermediate piston situated between the piezoelectric actuator and the first piston; and a disk-shaped element situated on the intermediate piston, the disk-shaped element being in the form of a seat for the spring component.

9. The injector according to claim 8, wherein the disk-shaped element is in the form of a snap ring, the snap ring being situated in a slot in the intermediate piston.

10. The injector according to claim 1, further comprising a fluid leak duct for removing leaked fluid in an area of the first piston.

* * * * *